United States Patent [19]

Ebert et al.

[11] 4,286,889

[45] Sep. 1, 1981

[54] ERROR CORRECTING TYPEWRITER WITH ELECTRONICALLY CONTROLLED BACKSPACING TO FACILITATE PERFECT OVERSTRIKE OF ERRORS

[75] Inventors: Hermann Ebert, Nuremberg; Gunter Bachmann, Zirndorf, both of Fed. Rep. of Germany

[73] Assignee: Triumph Werke Nurnberg A.G., Nuremberg, Fed. Rep. of Germany

[21] Appl. No.: 54,942

[22] Filed: Jul. 5, 1979

[30] Foreign Application Priority Data

Jul. 18, 1978 [DE] Fed. Rep. of Germany ..... 2831488

[51] Int. Cl.[3] ..... B41J 29/16

[52] U.S. Cl. ..... 400/697.1; 400/308; 400/310; 400/320; 400/903

[58] Field of Search ..... 400/123, 173, 308, 309, 400/310, 551, 696, 697, 697.1, 903, 902, 320

[56] References Cited

U.S. PATENT DOCUMENTS

| | | | |
|---|---|---|---|
| 2,872,015 | 2/1959 | Toggenburger | 400/309 |
| 3,764,993 | 10/1973 | Lettieri | 400/308 X |
| 3,780,846 | 12/1973 | Kolpek et al. | 400/697.1 X |
| 3,831,728 | 8/1974 | Woods et al. | 400/123 |
| 3,844,395 | 10/1974 | Mero et al. | 400/902 X |
| 3,993,179 | 11/1976 | Gubelmann et al. | 400/551 X |
| 4,024,447 | 5/1977 | Epstein | 400/903 X |
| 4,074,067 | 2/1978 | Speckhard | 400/902 X |
| 4,096,935 | 6/1978 | Hanakata et al. | 400/697 X |
| 4,181,444 | 1/1980 | Heider | 400/551 X |

FOREIGN PATENT DOCUMENTS

| | | | |
|---|---|---|---|
| 1403629 | 8/1975 | United Kingdom | 400/903 |

OTHER PUBLICATIONS

IBM Technical Disclosure Bulletin, "Error Correction For Proportional Spacing Typewriter," Johnson et al., vol. 12, No. 5, Oct. 1969, pp. 645–646.

*Primary Examiner*—Ernest T. Wright, Jr.

[57] ABSTRACT

An error correcting typewriter wherein a backspace correction key is operative to read an incorrect character from memory, to in turn reversely move a stepper motor controlled carriage twice the width of a character in error and then forwardly the width of the character in error and then to effect overstrike printing of the character in error.

4 Claims, 2 Drawing Figures

ERROR CORRECTING TYPEWRITER WITH ELECTRONICALLY CONTROLLED BACKSPACING TO FACILITATE PERFECT OVERSTRIKE OF ERRORS

This invention relates to error correcting typewriters; more particularly it relates to an error correcting typewriter having a backspace correction control for accurately positioning a stepper motor driven carriage to allow the character in error to be accurately overprinted through an error ribbon; and specifically to an error correcting typewriter in which the backspace correction key reads an incorrect character out of memory and effects its overprinting on the record following carriage movement to the incorrect character space.

Error correcting typewriters exist in the art, e.g. U.S. Pat. No. 3,993,179 wherein a backspace key effects read out of a stored character for the purpose of determining its width and then controlling reverse movement of a carriage according to the width of the character; following which the character is deleted from storage. The error, however, remains on the draft copy of printed record and is later overstruck with a different correct character which is also recorded in a record for replay to produce a final error-free printed copy.

In the above prior art, the carriage is incrementally indexed mechanically in escapement direction by an escapement rack and pawl and in reverse direction by a backspace pawl sufficiently to allow the escapement pawl to accurately reengage a preceding tooth on the rack.

In electronically controlled typewriters, stepping motors are employed to drive the carriages in escapement and backspace directions, usually through gears and/or cable systems. Due to the fact that positions are held by a magnetic field in the motor and due to tolerance effects in the motor and gear or cable systems, reverse or backspace incremental movement differs from a forward or escapement incremental movement with the result that a character in error to be typed out may not be perfectly overstruck resulting in imperfect erasure.

In accordance with the invention, an error-free printed record and electronically stored record for later editing as may be deemed necessary can be produced on the first typing. Further in accordance with the invention, a stepper motor controlled carriage is energized in response to a backspace correction key to effect a reverse carriage movement twice the width of the character read from memory and then a forward movement equal to the width of the character resulting in movement exactly to the incorrect character on the printed record following which the incorrect character read from memory is caused to print exactly over its previously printed representation allowing not only a correct character to be printed in the same space but also to be recorded in and the incorrect character erased from memory. Thus, an error-free printed copy can be achieved on first writing.

An object of the invention is to provide an error correction typewriter which enables an error-free printed record to be produced on first typing.

Another object of the invention is in the provision of an electronically controlled typewriter having a stepper motor driven carriage which can be accurately backspaced to a previously written incorrect character.

Another object of the invention is in the provision of an error correcting typewriter having a stepper motor driven carriage in which backspace operation causes read out of memory of a character in error, movement of the carriage in a reverse direction twice the width of the character and forward one width, and accurate overstriking on the printed record of the incorrect character to effect erasure thereof.

Other objects, features and advantages of the present invention will become known to those skilled in the art from a reading of the following detailed description when taken in conjunction with the accompanying drawing wherein like reference numerals designate like or correspondence parts throughout the several views thereof, and wherein.

Figure 1:
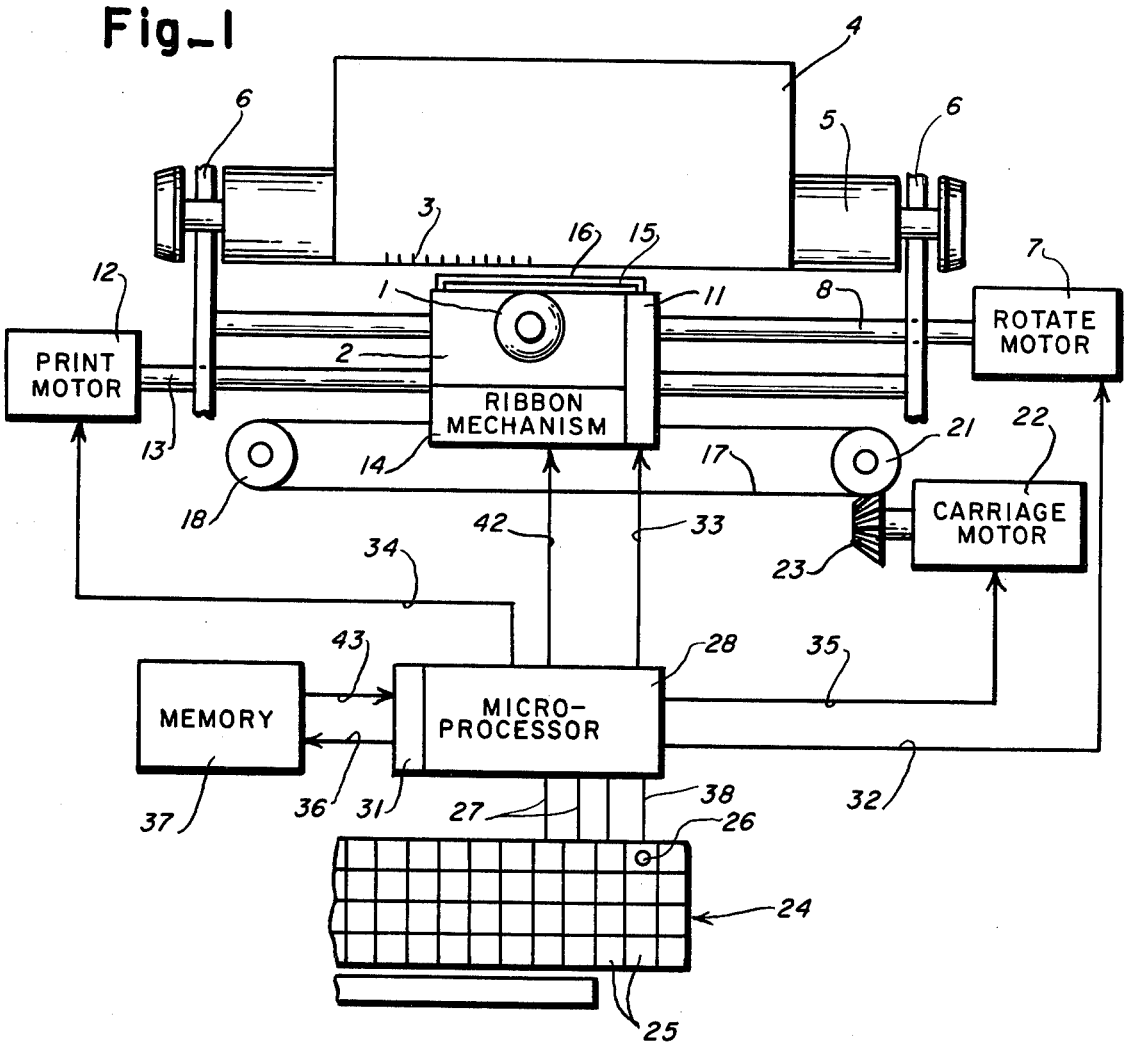
FIG. 1 is a schematic view of an electronically controlled typewriter.

Referring now to the drawing there is shown in FIG. 1 a typewriter having a single element type body 1 supported on a carriage 2 which is movable horizontally along a printing line to print characters 3 on a printed record 4 trained about a platen 5 supported in side frames 6. In the embodiment illustrated the type body 1 is in the form of a ball though other type bodies, e.g. a disk with character supporting spokes, are within the invention as are machines in which the platen 5 is supported on a carriage for movement relative to the type body 1.

The type body 1 is adapted to be rotatably positioned by a rotate stepping motor 7 whose discrete rotary movements are transmitted to rotate the type body 1 by means of a shaft 8. The type body 1 is also adapted to be tiltably positioned by an electromagnet-operated aggregate motion mechanism 11. As in known, the rotate and tilt positioning movement present a selected type on the type body 1 opposite the platen 5. When so positioned, the type body 1 is swung to print against the platen supported record 4 by another stepping motor 12 whose motion is transmitted via a shaft 13 to the type body 1. The printing motion also acts on carriage supported ribbon mechanism 14 to elevate a printing ribbon 15 between the type body 1 and record 4. The ribbon mechanism 14 also includes an error correction ribbon 16 which, when conditioned for operation, is also elevated by the printing motion between the printing ribbon 15 and the record 4.

As shown, the carriage 2 is movable along a writing line in both directions by a cable 17 whose ends are secured to opposite sides of the carriage 2 from whence they are trained in a loop about left and right frame supported rollers 18 and 21. One of the rollers 21 is connected to be driven by a carriage stepping motor 22 coupled thereto as by gearing 23.

As shown in FIG. 1, the typewriter includes a signal generating keyboard 24 having a plurality of character and function keys 25 and a backspace correction key 26. Coded signals emanating from the keyboard 24 corresponding to each key depression are conveyed over lines 27 to a programmed central process unit (CPU) or microprocessor 28 and held in a single character register 31. The CPU 28 acts on the code in the register 31 and issues the proper signals over line 32 to the rotate motor 7, over line 33 to the tilt mechanism 11, over line 34 to the print motor 12, and over line 35 to the carriage motor 22 thereby to print a selected character and move the carriage 2 its character width. The signals in the register 31 in the CPU 28 are transferred over line 36 to a memory unit 37, e.g. a floppy disk memory, upon entry into the register 31 of the next character to be printed.

Figure 2:
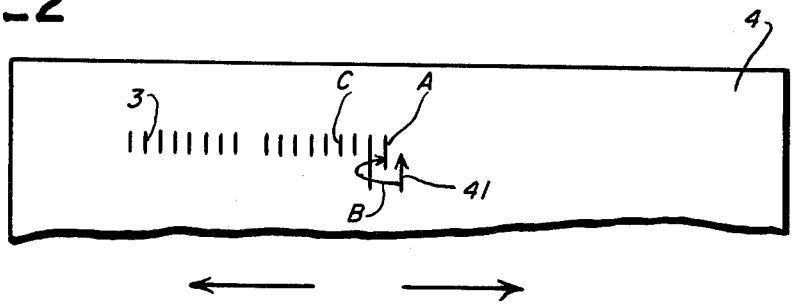
FIG. 2 is a front view of a printed record illustrating a backspace movement in accordance with the invention.

When an operator perceives that an incorrect character has been typed, e.g. the last one typed, at position A (FIG. 2), the backspace correction key 26 is depressed and issues a signal over line 38 to the CPU 28 which causes the character in the register 31, i.e., the character printed at position A, to be decoded in terms of its width and identity, issuing signals to the carriage motor 22 to move the carriage 2 in backspace direction twice the width and in escapement direction the width of the character as illustrated in FIG. 2 by line B to accurately reposition the printing point 41 at position A, while positioning the type body 1 to present the incorrect character for printing. Then, after conditioning the ribbon mechanism 14 over line 42 so that the print action will elevate the error ribbon 16, CPU 28 energizes the print motor 12 thereby to again print the incorrect character and thereby erase the incorrect character on the printed record 4 at position A. This print action is silent, i.e., the CPU 28 issues no signal to the carriage motor 22 over line 35 incident to printing the incorrect character. Thus, a correct character can now be printed. Its entry into the register 31 erases the incorrect character therein without transferring it to the memory 37.

If the operator perceives an incorrect character preceding the last character printed, e.g. at position C, and thus one in the memory 37, the backspace key 26 is depressed repeatedly, with all the characters between position A and including the incorrect character at position C being obliterated on the printed record 4. Each backspace signal following the first causes a transfer from memory 37 over line 43 to the register 31, thus clearing the memory 37, with each transfer from memory 37 erasing the character in the register 31.

Following this erasure sequence, typing may resume beginning with position C. Where the platen 5 is indexed by a stepping motor (not shown) and tolerances are different in opposite rotary directions, the same principle of two reverse and one forward movement may be employed to correct characters in earlier lines or when subscripts and superscripts are to be corrected.

The invention claimed is:

1. In a typewriter having a carriage and a stepping motor connected to incrementally drive said carriage in escapement direction to print a line of characters and in backspace direction to correct errors, a backspace correction key, and control means responsive to operation of said backspace correction key for energizing said stepping motor to move said carriage in backspace direction twice the width of the last character printed and in escapement direction the width of the last character printed thereby to accurately locate said carriage at the last printed character space for correction.

2. In a typewriter as recited in claim 1, including a single element type body mounted on said carriage and means for positioning said type body to present a selected character for printing, said control means comprising a central process unit including a memory wherein the last selected character printed is stored, said central process unit being operative to read said last character out of memory to effect printing thereof following backspace carriage movement.

3. In a typewriter as recited in claim 2, including a keyboard for selecting characters to be printed, said control means being operative to erase the last printed character from said memory upon entry of a new character therein selected by said keyboard.

4. In an error correcting electronically controlled typewriter having a single element type body, positioning means operative to position a type to be printed, ribbon mechanism for supporting and for elevating to print position a printing and an error correction ribbon, a carriage supporting said type body and said ribbon mechanism, motor means for incrementally driving said carriage in escapement direction to print a line of characters and in backspace direction to correct errors, print means operative on said ribbon mechanism to elevate said printing ribbon and to move said type body to print the selected type, a signal generating keyboard, a central process unit, including memory means, for processing keyboard generated signals thereby to operate said positioning means, said print means and said motor means and for storing keyboard generated signals in said memory, said keyboard including a backspace correction key, said central process unit being responsive to backspace correction key signals to read out of memory the last character printed, to energize said motor means to incrementally move said carriage twice the width of the last character printed in backspace direction and the width of the last character printed in escapement direction, to operate said positioning means to position the type body to present the character read out of memory for printing, to condition the ribbon mechanism to elevate the error correction ribbon incident to a print action, to operate said print means, and to inhibit a signal to the motor means whereby the character read out of memory accurately overstrikes its previous printout to allow a next character to be typed in the same space.

* * * * *